US011322096B2

(12) United States Patent
Lee et al.

(10) Patent No.: US 11,322,096 B2
(45) Date of Patent: May 3, 2022

(54) DATA DRIVER AND DISPLAY DEVICE INCLUDING THE SAME

(71) Applicant: SAMSUNG DISPLAY CO., LTD., Yongin-si (KR)

(72) Inventors: Seong Joo Lee, Yongin-si (KR); Oh Jo Kwon, Yongin-si (KR); Ji Woong Kim, Yongin-si (KR); Hyung Gun Ma, Yongin-si (KR); Jun Yong Song, Yongin-si (KR); Sang Hyun Heo, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/197,550

(22) Filed: Mar. 10, 2021

(65) Prior Publication Data

US 2022/0044640 A1 Feb. 10, 2022

(30) Foreign Application Priority Data

Aug. 10, 2020 (KR) ..... 10-2020-0100137

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/027* (2013.01); *G09G 2310/0243* (2013.01); *G09G 2310/0291* (2013.01); *G09G 2310/0294* (2013.01); *G09G 2310/066* (2013.01); *G09G 2330/028* (2013.01)

(58) Field of Classification Search
CPC ..... G09G 3/3275; G09G 3/3266; G09G 2310/0243; G09G 2310/027; G09G 2310/0291; G09G 2310/0294; G09G 2310/066; G09G 2330/028
USPC ..... 345/691
See application file for complete search history.

(56) References Cited

U.S. PATENT DOCUMENTS 7,616,221 B2 11/2009 Kudo et al.
2009/0278865 A1* 11/2009 Kang ..... G09G 3/3688 345/690
2012/0206506 A1* 8/2012 Kim ..... G09G 3/20 345/690

(Continued)

FOREIGN PATENT DOCUMENTS

KR 100605077 B1 7/2006
KR 1020090116288 A 11/2009

*Primary Examiner* — Tom V Sheng
(74) *Attorney, Agent, or Firm* — Cantor Colburn LLP

(57) ABSTRACT

A data driver includes: a signal generator which includes a staircase waveform gray voltage signal generator which generate a plurality of staircase waveform gray voltage signals using a lowest gamma reference voltage, a highest gamma reference voltage, and a plurality of gamma voltages having a magnitude between the lowest gamma reference voltage and the highest gamma reference voltage; and a channel driver which includes a decoder which output one staircase waveform gray voltage signal selected from the staircase waveform gray voltage signals, an output circuit which output a gray voltage corresponding to the selected staircase waveform gray voltage signal, and a reset unit which supplies one of the gamma voltages to the output circuit as a reset voltage.

20 Claims, 12 Drawing Sheets

(56) References Cited

U.S. PATENT DOCUMENTS

| | | | | |
|---|---|---|---|---|
| 2016/0189643 | A1* | 6/2016 | Uchiyama | G09G 3/3607<br>345/690 |
| 2020/0327859 | A1* | 10/2020 | Uchiyama | G09G 3/2096 |

* cited by examiner

FIG. 8

| 0 TO 15 GRAY LEVEL EXPRESSION | | |
|---|---|---|
| GRAY LEVEL | UPPER 4-BIT | LOWER 4-BIT |
| 0 | 0000 | 0000 |
| 1 | | 0001 |
| 2 | | 0010 |
| 3 | | 0011 |
| 4 | | 0100 |
| 5 | | 0101 |
| 6 | | 0110 |
| 7 | | 0111 |
| 8 | | 1000 |
| 9 | | 1001 |
| 10 | | 1010 |
| 11 | | 1011 |
| 12 | | 1100 |
| 13 | | 1101 |
| 14 | | 1110 |
| 15 | | 1111 |

| 16 TO 31 GRAY LEVEL EXPRESSION | | |
|---|---|---|
| GRAY LEVEL | UPPER 4-BIT | LOWER 4-BIT |
| 16 | 0001 | 0000 |
| 17 | | 0001 |
| 18 | | 0010 |
| 19 | | 0011 |
| 20 | | 0100 |
| 21 | | 0101 |
| 22 | | 0110 |
| 23 | | 0111 |
| 24 | | 1000 |
| 25 | | 1001 |
| 26 | | 1010 |
| 27 | | 1011 |
| 28 | | 1100 |
| 29 | | 1101 |
| 30 | | 1110 |
| 31 | | 1111 |

| 32 TO 47 GRAY LEVEL EXPRESSION | | |
|---|---|---|
| GRAY LEVEL | UPPER 4-BIT | LOWER 4-BIT |
| 32 | 0010 | 0000 |
| 33 | | 0001 |
| 34 | | 0010 |
| 35 | | 0011 |
| 36 | | 0100 |
| 37 | | 0101 |
| 38 | | 0110 |
| 39 | | 0111 |
| 40 | | 1000 |
| 41 | | 1001 |
| 42 | | 1010 |
| 43 | | 1011 |
| 44 | | 1100 |
| 45 | | 1101 |
| 46 | | 1110 |
| 47 | | 1111 |

| 48 TO 63 GRAY LEVEL EXPRESSION | | |
|---|---|---|
| GRAY LEVEL | UPPER 4-BIT | LOWER 4-BIT |
| 48 | 0011 | 0000 |
| 49 | | 0001 |
| 50 | | 0010 |
| 51 | | 0011 |
| 52 | | 0100 |
| 53 | | 0101 |
| 54 | | 0110 |
| 55 | | 0111 |
| 56 | | 1000 |
| 57 | | 1001 |
| 58 | | 1010 |
| 59 | | 1011 |
| 60 | | 1100 |
| 61 | | 1101 |
| 62 | | 1110 |
| 63 | | 1111 |

. . .

| 240 TO 255 GRAY LEVEL EXPRESSION | | |
|---|---|---|
| GRAY LEVEL | UPPER 4-BIT | LOWER 4-BIT |
| 240 | 1111 | 0000 |
| 241 | | 0001 |
| 242 | | 0010 |
| 243 | | 0011 |
| 244 | | 0100 |
| 245 | | 0101 |
| 246 | | 0110 |
| 247 | | 0111 |
| 248 | | 1000 |
| 249 | | 1001 |
| 250 | | 1010 |
| 251 | | 1011 |
| 252 | | 1100 |
| 253 | | 1101 |
| 254 | | 1110 |
| 255 | | 1111 |

DATA DRIVER AND DISPLAY DEVICE INCLUDING THE SAME

This application claims priority to Korean Patent Application No. 10-2020-0100137, filed on, Aug. 10, 2020, and all the benefits accruing therefrom under 35 U.S.C. § 119, the content of which in its entirety is herein incorporated by reference.

BACKGROUND

1. Field

The present invention relates to a data driver and a display device including the same.

2. Description of the Related Art

With the development of information technologies, the importance of a display device that serves as a connection medium between a user and information increases. Accordingly, a display device such as a liquid crystal display device or an organic light-emitting display device is increasingly used.

The display device may include pixels connected to scan lines and data lines, a scan driver for driving the scan lines, a data driver for driving the data lines, a gray voltage generator for supplying gray voltages to the data driver, and a timing controller for supplying image data to the data driver.

The data driver may generate data voltages corresponding to pieces of input image data using gray voltages for each channel. In this case, each channel may include a decoder (or multiplexer) for selecting one gray voltage corresponding to image data from a plurality of gray voltages. An area occupied by the decoder in the channel may be increased in proportion to the number of gray levels to be expressed.

In order to reduce the area occupied by the decoder in the channel, a method of converting a plurality of gray voltages with a time axis to generate grouped staircase waveform gray voltage signals (hereinafter, referred to as ramp signals) and supplying the ramp signals to the decoder has been proposed.

SUMMARY

However, in a method of supplying grouped ramp signals to a decoder of a data driver, an operation (or sampling/holding operation) of selecting and maintaining any one of the ramp signals to generate a data voltage may be performed in one horizontal period unit. In this case, when a large voltage difference occurs, such as when a gray level is changed from a high gray level (gray level of 255) to a low gray level (gray level of zero) or from the low gray level (gray level of zero) to the high gray level (gray level of 255) every horizontal period, in the display device, current consumption for the sampling/holding operation may be increased.

In addition, in order to stably perform the sampling/holding operation, it is desirable to reach a gray level corresponding to the selected ramp signal within at least 1/16-horizontal period (1/16H), and when current consumption is reduced, the ramp signal is difficult to stabilize. Thus, the linearity of the ramp signals may be broken.

An embodiment of the present invention provides a data driver capable of reducing average current consumption during a sampling/holding operation by supplying the number of ramp signals less than the number of gray voltages to a decoder.

Another aspect of the present invention is to provide a data driver capable of maintaining the linearity of ramp signals during a sampling/holding operation by supplying the number of the ramp signals less than the number of gray voltages to a decoder.

It should be understood, however, that the aspect of the present invention may be not to be limited by the foregoing aspect, but may be variously expanded without departing from the spirit and scope of the present invention.

To solve the above problems, a data driver according to an embodiment of the present invention includes: a signal generator which includes a staircase waveform gray voltage signal generator which generates a plurality of staircase waveform gray voltage signals using a lowest gamma reference voltage, a highest gamma reference voltage, and a plurality of gamma voltages having a magnitude between the lowest gamma reference voltage and the highest gamma reference voltage; and a channel driver which includes a decoder which outputs one staircase waveform gray voltage signal selected from the staircase waveform gray voltage signals, an output circuit which outputs a gray voltage corresponding to the selected staircase waveform gray voltage signal, and a reset unit which supplies one of the gamma voltages to the output circuit as a reset voltage.

The decoder may select one staircase waveform gray voltage signal from the plurality of staircase waveform gray voltage signals every horizontal period.

The reset voltage may be the one gamma voltage of the plurality of gamma voltages, which corresponds to an intermediate value between a final gray voltage of one staircase waveform gray voltage signal selected in a previous horizontal period and an initial gray voltage of one staircase waveform gray voltage signal selected in a current horizontal period.

The reset unit may detect the one staircase waveform gray voltage signal selected in the previous horizontal period and the one staircase waveform gray voltage signal selected in the current horizontal period using the upper bits of the image data supplied to the decoder.

The reset unit may supply the reset voltage to the output circuit every horizontal period and may supply the reset voltage to the output circuit before the one staircase waveform gray voltage signal selected by the decoder is supplied to the output circuit.

Each of the plurality of staircase waveform gray voltage signals may increase stepwise with a plurality of gray voltage levels every horizontal period.

Each of the plurality of staircase waveform gray voltage signals may alternately increase and decrease stepwise with a plurality of gray voltages every other horizontal period.

The signal generator may further include a pulse width modulation ("PWM") signal generation circuit which generates a plurality of PWM signals according to a digital code generated based on an oscillation signal.

The PWM signal generation circuit may include: an oscillator which generates the oscillation signal; a frequency divider which divides a frequency of the oscillation signal at a constant division ratio and generates an oscillation signal having the divided frequency; a code generator which counts the oscillation signal having the divided frequency and generates the digital code as a result of the count; and a PWM signal generator which generates the plurality of PWM signals in response to the digital code.

The channel driver may further include a switching signal generation circuit which generates a plurality of switching signals using any one PWM signal selected from the plurality of PWM signals in response to the b lower bits.

The switching signal generation circuit may include: a selection circuit which outputs the one PWM signal selected from the plurality of PWM signals in response to the lower bits of image data; and a level shifter which generates the plurality of switching signals by shifting a level of the one PWM signal output from the selection circuit.

The output circuit may include a capacitor and a plurality of switches which perform a sampling/holding operation on the gray voltage corresponding to the selected staircase waveform gray voltage signal in response to the plurality of switching signals, and an operational amplifier which amplifies a voltage held in the capacitor through the sampling/holding operation.

The operational amplifier may include a first input terminal which receives a reference voltage, a second input terminal connected to a first terminal of the capacitor, and an output terminal. The capacitor may include a second terminal connected to a first node.

The plurality of switches may include a first switch positioned between the reset unit and the first node, a second switch positioned between the second input terminal of the operational amplifier and the output terminal of the operational amplifier, and a third switch positioned between an output terminal of the decoder and the first node, and a fourth switch positioned between the output terminal of the operational amplifier and the first node.

The first switch may be turned on before the third switch is turned on and then the first switch may be turned off after the third switch is turned on.

A display device according to an embodiment of the present invention includes a pixel unit which includes a plurality of pixels connected to data line, and a data driver which supplies data signals to the data lines.

The data driver includes: a signal generator which includes a staircase waveform gray voltage signal generation which generates a plurality of staircase waveform gray voltage signals using a lowest gamma reference voltage, a highest gamma reference voltage, and a plurality of gamma voltages having a magnitude between the lowest gamma reference voltage and the highest gamma reference voltage; and a channel driver which includes a decoder which outputs one staircase waveform gray voltage signal selected from the staircase waveform gray voltage signals, an output circuit which outputs a gray voltage corresponding to the selected staircase waveform gray voltage signals to the data line as a data signal, and a reset unit which supplies one of the gamma voltages to the output circuit as a reset voltage.

The decoder may select one staircase waveform gray voltage signal from the plurality of staircase waveform gray voltage signals every horizontal period.

The reset voltage may be the one gamma voltage of the plurality of gamma voltages, which corresponds to an intermediate value of a final gray voltage of one staircase waveform gray voltage signal selected in a previous horizontal period and an initial gray voltage of one staircase waveform gray voltage signal selected in a current horizontal period.

The reset unit may detect the one staircase waveform gray voltage signal selected in the previous horizontal period and the one staircase waveform gray voltage signal selected in the current horizontal period using the upper bits of the image data supplied to the decoder.

The reset unit may supply the reset voltage to the output circuit every horizontal period and may supply the reset voltage to the output circuit before the one staircase waveform gray voltage signal selected by the decoder is supplied to the output circuit.

Each of the plurality of staircase waveform gray voltage signals may increase stepwise with a plurality of gray voltage levels every horizontal period.

The display device may further include a gamma reference voltage supply unit which supplies the lowest gamma reference voltage, the highest gamma reference voltage, and the plurality of gamma voltages to the data driver.

BRIEF DESCRIPTION OF THE DRAWINGS

FIG. 8 shows a table in which 8-bit image data is divided into upper 4-bits and lower 4-bits.

DETAILED DESCRIPTION

Hereinafter, embodiments of the present invention will be described in more detail with reference to the accompanying drawings. Like numbers refer to like elements throughout the description of the figures, and the description of the same component will not be reiterated.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise.

"At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
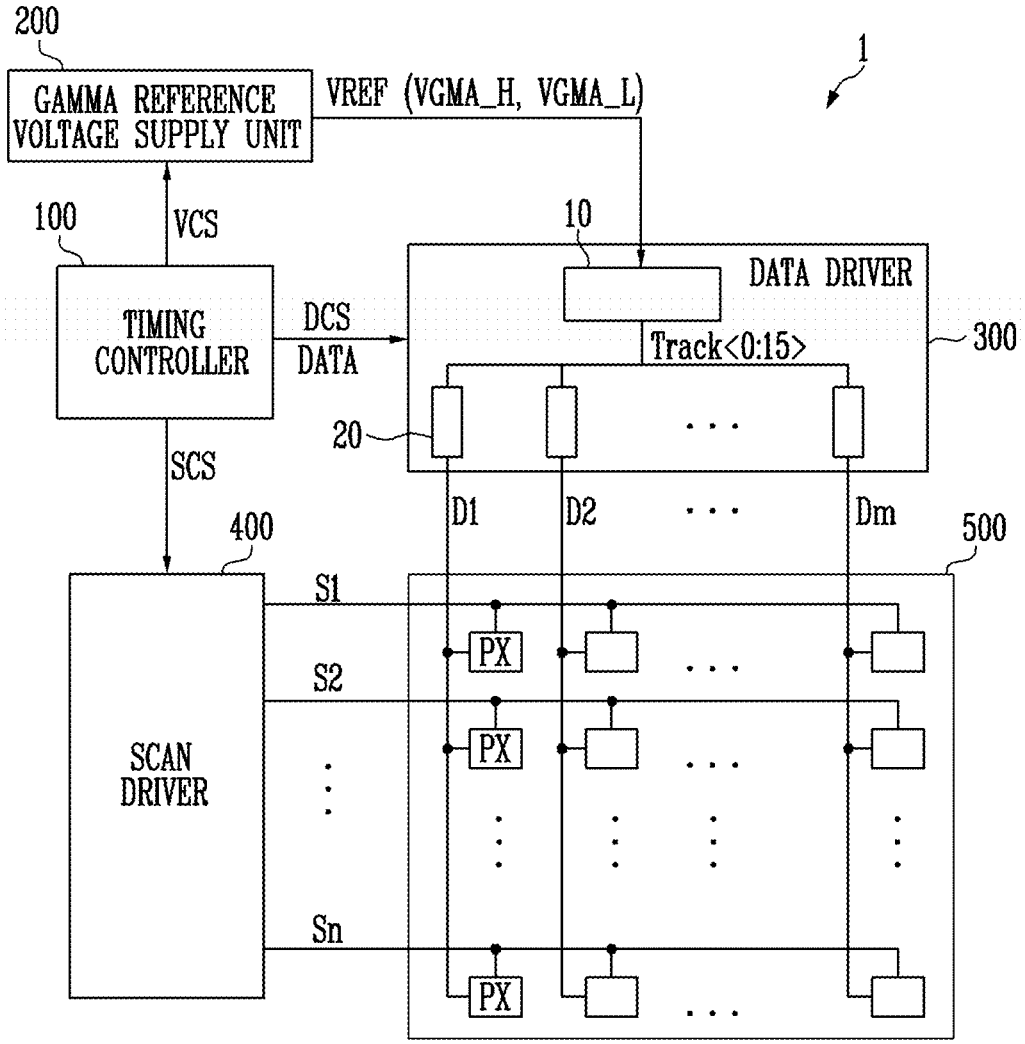
FIG. 1 is a schematic block diagram illustrating a display device according to an embodiment of the present invention.

FIG. 1 is a schematic block diagram illustrating a display device according to an embodiment of the present invention.

Referring to FIG. 1, a display device 1 according to an embodiment of the present invention may include a timing controller 100, a gamma reference voltage supply unit 200, a data driver 300, a scan driver 400, and a pixel unit 500.

The timing controller 100 may receive image data and synchronization signals and clock signals for controlling a display of the image data. The timing controller 100 may correct image data input from the outside to be suitable for an image display of the pixel unit 500 and may supply corrected image data DATA to the data driver 300.

The timing controller 100 may output a data control signal DCS for controlling an operation timing of the data driver 300 and a scan control signal SCS for controlling an operation timing of the scan driver 400. In addition, the timing controller 100 may output a voltage control signal VCS for controlling an operation timing of the gamma reference voltage supply unit 200 and a voltage level of a gamma reference voltage VREF.

The gamma reference voltage supply unit 200 may supply the gamma reference voltage VREF to the data driver 300. Here, the gamma reference voltage VREF may include the lowest gamma reference voltage VGMA_L corresponding to the lowest gray level value and the highest gamma reference voltage VGMA_H corresponding to the highest gray level value.

The data driver 300 may be connected to a plurality of data lines D1 to Dm and may supply data signals to the pixel unit 500 through the data lines D1 to Dm. The data driver 300 may generate data signals (or data voltages) in response to the data control signal DCS and may supply the generated data signals to the data lines D1 to Dm during a horizontal period. Here, m is a natural number.

As an example, the data driver 300 may generate an analog data signal so as to have a certain voltage value corresponding to a bit value (or gray level value) of the image data DATA based on the gamma reference voltage VREF.

According to an embodiment, the data driver 300 may include a signal generator 10 and a plurality of channel drivers 20. The signal generator 10 may generate a plurality of pulse width modulation (PWM) signals Track<0:15> and a plurality of staircase waveform gray voltage signals A1 to A16 according to a digital code (4-bit) generated based on an oscillation signal. Each of the plurality of channel drivers 20 may supply data signals generated in response to the plurality of PWM signals Track<0:15>, the plurality of staircase waveform gray voltage signals A1 to A16, and the image data DATA to the pixel unit 500 through the data lines D1 to Dm.

The scan driver 400 may be connected to scan lines S1 to Sn and may supply scan signals to the pixel unit 500 through the scan lines S1 to Sn. Specifically, the scan driver 400 may output scan signals by shifting a level of a gate voltage in response to the scan control signal SCS received from the timing controller 100. In an embodiment, the scan driver 400 may be provided with a plurality of stage circuit and may sequentially supply scan signals to the scan lines S1 to Sn. Here, n is a natural number.

The pixel unit 500 may display an image in response to the data signal supplied from the data driver 300 and the scan signal supplied from the scan driver 400. The pixel unit 500 may include a plurality of pixels PX connected to the scan lines S1 to Sn and the data lines D1 to Dm.

Specifically, the pixels PX are selected in a horizontal line unit in response to a scan signal supplied to any one of the scan lines S1 to Sn. In this case, each of the pixels PX selected by a scan signal may receive a data signal from any one of the data lines D1 to Dm connected thereto. Each of the pixels PX for receiving the data signal may emit light at a predetermined luminance corresponding to the data signal. Each of the pixels PX may include subpixels for emitting red light, green light, and blue light, respectively. However, color light emitted by the subpixel according to the invention is not limited thereto. For example, each of the pixels PX may include subpixels for emitting red light, green light, blue light, and white light, respectively.

According to one embodiment, the data driver 300 may display a predetermined image in the pixel unit 500 by supplying a data signal corresponding to data every horizontal period. The scan driver 400 may sequentially supply scan signals every horizontal period to select the pixels PX to which data signals are to be supplied.

Figure 2:
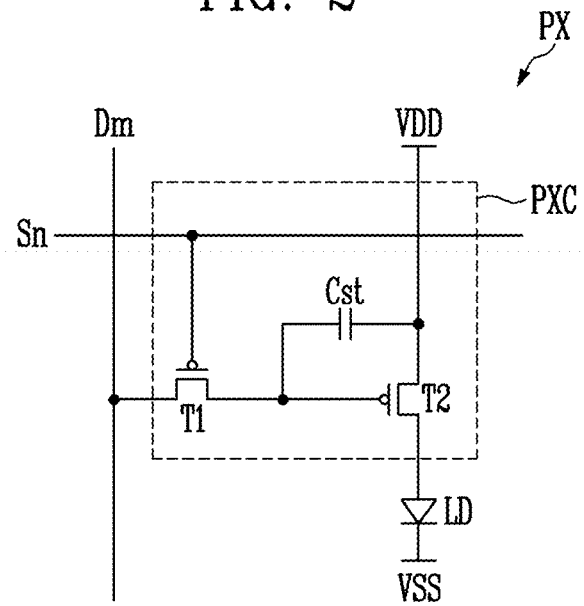
FIG. 2 is a diagram illustrating an embodiment of the pixel illustrated in FIG. 1.

FIG. 2 is a diagram illustrating an embodiment of the pixel illustrated in FIG. 1. In particular, in FIG. 2, for convenience of description, a pixel connected to an $n^{th}$ scan line Sn and an $m^{th}$ data line Dm are illustrated.

Referring to FIG. 2, each pixel PX may include a light-emitting diode LD and a pixel circuit PXC connected to the data line Dm and the scan line Sn to control the light-emitting diode LD.

An anode of the light-emitting diode LD may be connected to the pixel circuit PXC, and a cathode of the light-emitting diode LD may be connected to a second voltage source VSS.

The light-emitting diode LD may generate light at a predetermined luminance in response to a current supplied from the pixel circuit PXC.

The light-emitting diode LD may be provided as an organic light-emitting diode or an inorganic light-emitting diode such as a micro light-emitting diode ("micro LED") or a quantum dot light-emitting diode. Furthermore, the light-emitting diode LD may be a light-emitting diode made of a combination of an organic material and an inorganic material. In FIG. 2, the pixel PX is illustrated to include the single light-emitting diode LD, but in other embodiments, the pixel PX may include a plurality of light-emitting diodes. The plurality of light-emitting diodes may be connected in series, in parallel, or in series and parallel.

When a scan signal is supplied to the scan line Sn, the pixel circuit PXC controls an amount of a current supplied to the light-emitting diode LD in response to a data signal supplied to the data line Dm. To this end, the pixel circuit PXC includes a second transistor T2 connected between a first voltage source VDD and the light-emitting diode LD, a first transistor T1 connected between the second transistor T2, the data line Dm, and the scan line Sn, and a storage capacitor Cst connected between a gate electrode and a first electrode of the second transistor T2.

A gate electrode of the first transistor T1 is connected to the scan line Sn, and a first electrode source of the first transistor T1 is connected to the data line Dm. A second electrode of the first transistor T1 is connected to one terminal of the storage capacitor Cst.

Here, the first electrode is set as one of a source electrode and a drain electrode, and the second electrode is set as the other one of the source electrode and the drain electrode. For example, when the first electrode is set as a source electrode, the second electrode is set as a drain electrode.

The first transistor T1 connected to the scan line Sn and the data line Dm is turned on when a scan signal is supplied from the scan line Sn, thereby supplying a data signal from the data line Dm to the storage capacitor Cst. In this case, the storage capacitor Cst is charged with a voltage corresponding to the data signal.

The gate electrode of the second transistor T2 is connected to one terminal of the storage capacitor Cst, and the first electrode of the second transistor T2 is connected to the other terminal of the storage capacitor Cst and the first voltage source VDD. A second electrode of the second transistor T2 is connected to the anode of the light-emitting diode LD.

The second transistor T2 controls an amount of current flowing from the first voltage source VDD to the second voltage source VSS via the light-emitting diode LD in response to a voltage value stored in the storage capacitor Cst. In this case, the light-emitting diode LD generates light corresponding to an amount of current supplied from the second transistor T2.

Since the above-described structure of the pixel of FIG. 2 is merely an embodiment of the present invention, the pixel PX of the present invention is not limited to the structure of the pixel. Actually, the pixel circuit PXC may have a circuit structure capable of supplying a current to the light-emitting diode LD and may be selected as any one of various structures currently know in the art.

Figure 3:
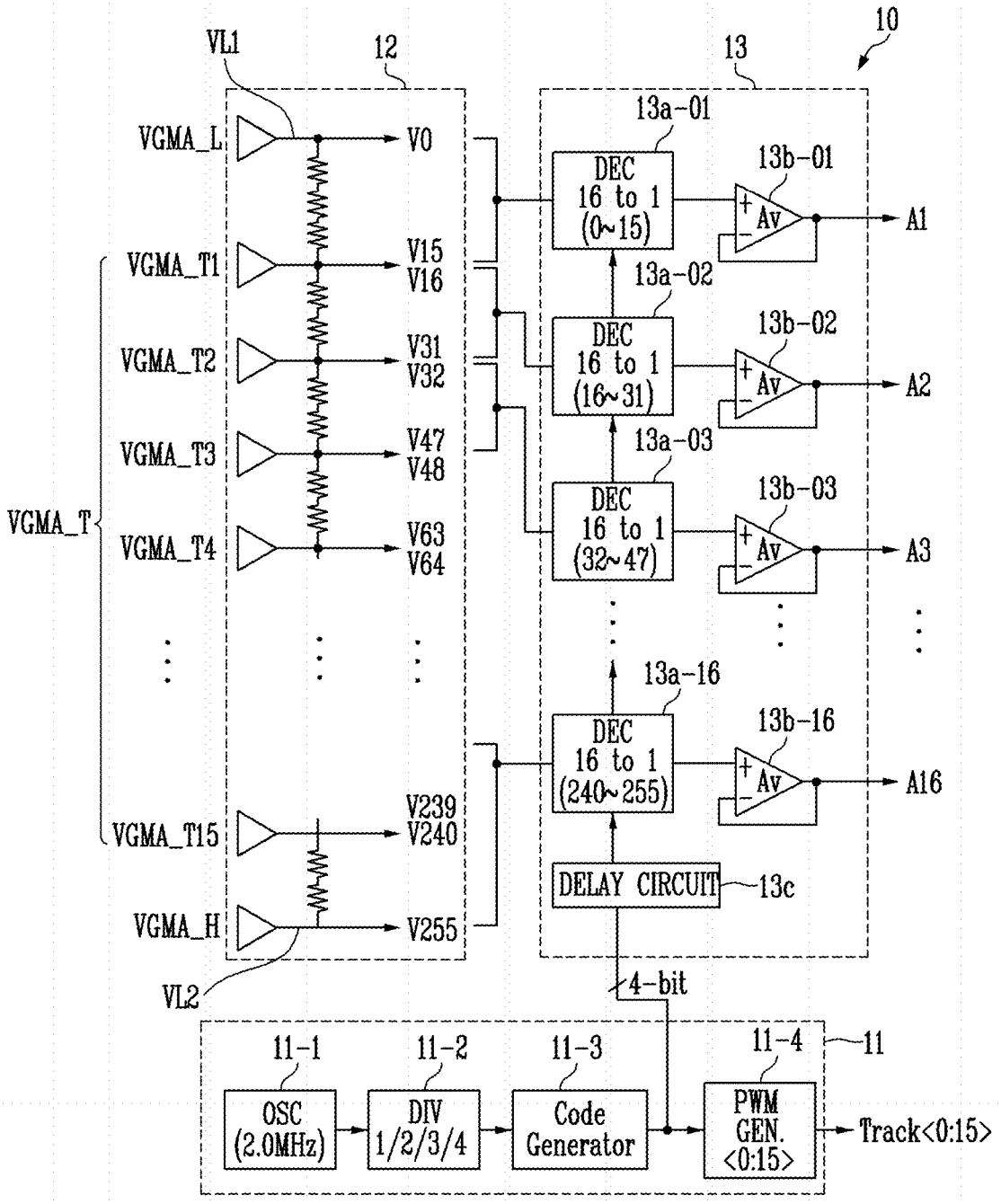
FIG. 3 is a schematic block diagram of a signal generator of FIG. 1.
Figure 4:
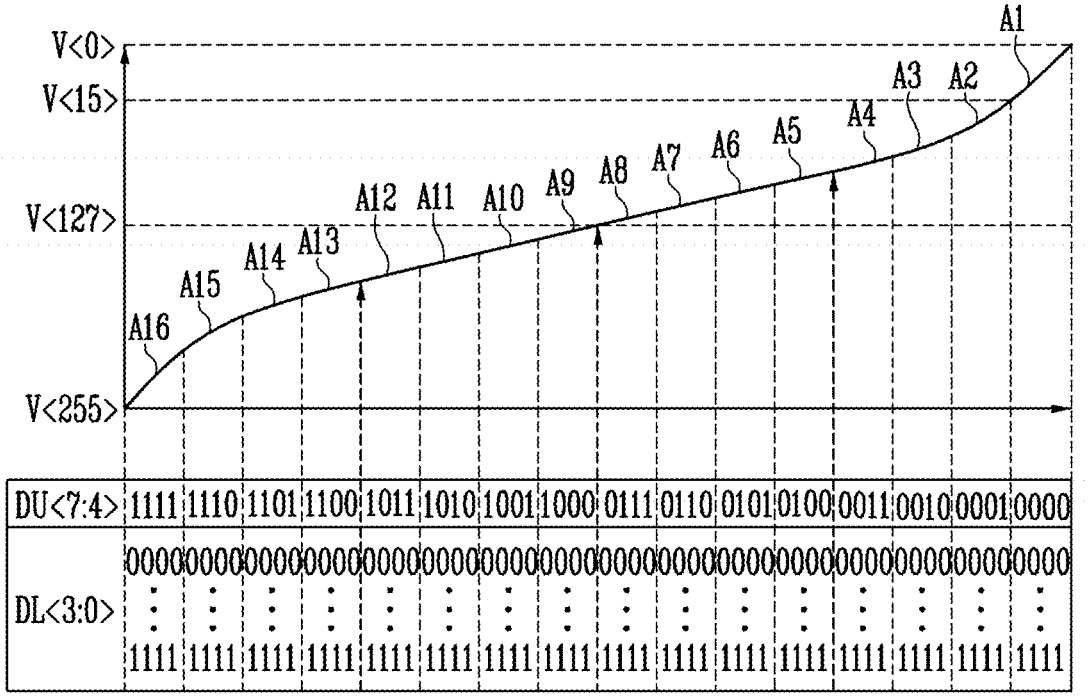
FIG. 4 is a graph for describing a relationship between a digital staircase waveform gray voltage signal and an analog gray voltage.

FIG. 3 is a schematic block diagram of the signal generator of FIG. 1. FIG. 4 is a graph for describing a relationship between a digital staircase waveform gray voltage signal and an analog gray voltage.

Referring to FIG. 3, the signal generator 10 may include a PWM signal generation circuit 11, a gray voltage generator 12, and a staircase waveform gray voltage signal generation circuit 13.

The PWM signal generation circuit 11 may generate a plurality of PWM signals Track<0:15> according to a digital code (4-bit) generated based on an oscillation signal.

The PWM signal generation circuit 11 may include an oscillator 11-1, a frequency divider 11-2, a code generator 11-3, and a PWM signal generator 11-4.

The oscillator 11-1 may generate an oscillation signal having a frequency of, for example, about 2.0 megahertz (MHz). In addition, the oscillator 11-1 may generate an oscillation signal having a frequency of about 1.5 MHz to about 2.5 MHz. According to embodiments, the oscillator 11-1 may be implemented as a crystal oscillator.

The frequency divider 11-2 may divide a frequency of an oscillation signal generated by the oscillator 11-1 at a constant division ratio and may generate an oscillation signal having the divided frequency. For example, the division ratio may be a real number.

In an embodiment, for example, when the frequency of the oscillation signal is 2 MHz, the frequency divider 11-2, of which a division ratio is set to one, may generate an oscillation signal having a cycle of 0.5 microseconds (μs), the frequency divider 11-2, of which a division ratio is set to two, may generate an oscillation signal having a cycle of 1.0 μs, and the frequency divider 11-2, of which a division ratio is set to four, may generate an oscillation signal having a cycle of 2.0 μs. As a division ratio is increased, power consumed by the data driver 300 (or signal generator 10) may be decreased.

The frequency divider 11-2 may include a register (not shown) for setting a division ratio. Furthermore, the frequency divider 11-2 may generate an oscillation signal having a frequency divided according to a division ratio set in an external register (not shown).

The code generator 11-3 implementable as a counter may count the oscillation signal having the divided frequency generated by the frequency divider 11-2 and generate a digital code (e.g., 4-bit) as a count result. For example, the code generator 11-3 may count the number of rising edges or falling edges of the oscillation signal and generate a K-bit digital code (e.g., 4-bit) corresponding to a count result. Here, K is a natural number, and in the present specification, for convenience of description, K is set as K=4.

Figure 6:
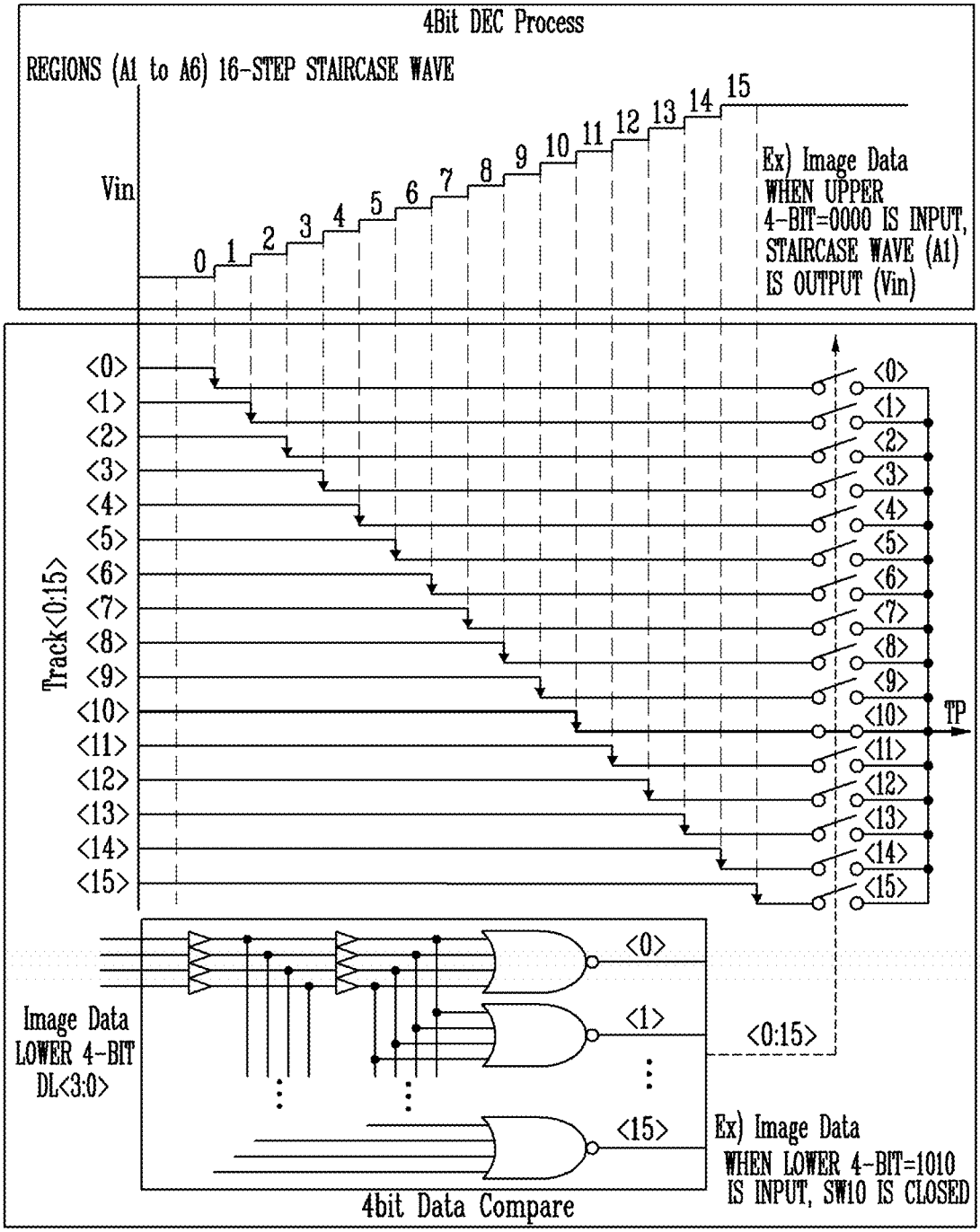
FIG. 6 is a graph showing a tracking process of a pulse width modulation (PWM) signal.

The PWM signal generator 11-4 may generate a plurality of PWM signals Track<0:15> in response to the 4-bit digital code (4-bit) generated by the code generator 11-3. For example, when the 4-bit digital code (4-bit) is sequentially increased from 0000 to 1111, as illustrated in FIG. 6, the PWM signal generator 11-4 may generate the plurality of PWM signals Track<0:15> in which a pulse width is increased in a least significant bit (1 "LSB") cycle as illustrated in FIG. 6.

The gray voltage generator 12 may generate a plurality of gray voltages V0 to V255. In the present specification, a resistance string for generating 256 gray voltages V0 to V255 is illustrated. Here, the gray voltage generator 12 may generate the 256 gray voltages V0 to V255 using the resistance string connected between a first line VL1 for receiving the lowest gamma reference voltage VGMA_L and a second line VL2 for receiving the highest gamma reference voltage VGMA_H. For example, the lowest gamma reference voltage VGMA_L may be 9 voltages (V), and the highest gamma reference voltage VGMA_H may be 0 V.

According to an embodiment, the gray voltage generator 12 may receive a plurality of gamma tap voltages VGMA_T having a magnitude between the lowest gamma reference voltage VGMA_L and the highest gamma reference voltage VGMA_H from the gamma reference voltage supply unit 200.

The plurality of gamma tap voltages VGMA_T may include first to fifteenth gamma tap voltages VGMA_T1 to VGMA_T15 obtained by equally dividing the magnitude between the lowest gamma reference voltage VGMA_L and the highest gamma reference voltage VGMA_H into sixteen. For example, the first gamma tap voltage VGMA_T1 may have a final value of a first staircase waveform gray voltage signal A1 (that is, a gray voltage corresponding to V15) or an initial value of a second staircase waveform gray voltage signal A2 (that is, a gray voltage corresponding to V16).

The staircase waveform gray voltage signal generation circuit 13 may generate a plurality of staircase waveform gray voltage signals A1 to A16 according to the digital code (4-bit).

The plurality of staircase waveform gray voltage signals A1 to A16 may include a plurality of gray voltages V0 to V15, V16 to V31, V32 to V47, V48 to V63, V64 to V79, V80 to V95, V96 to V111, V112 to V127, V128 to V143, V144 to V159, V160 to V175, V176 to V191, V192 to V207, V208 to V223, V224 to V239, and V240 to V255 of the plurality of gray voltages V0 to V255, respectively, which are decoded according to the digital code (4-bit) output from the PWM signal generation circuit 11.

In an embodiment, for example, as illustrated in FIG. 4, the first staircase waveform gray voltage signal A1 may include the gray voltages V0 to V15 of a first group. The second staircase waveform gray voltage signal A2 may include the gray voltages V16 to V31 of a second group. The third staircase waveform gray voltage signal A3 may include the gray voltages V32 to V47 of a third group. The fourth staircase waveform gray voltage signal A4 may include the gray voltages V48 to V63 of a fourth group. The fifth staircase waveform gray voltage signal A5 may include the gray voltages V64 to V79 of a fifth group. The sixth staircase waveform gray voltage signal A6 may include the gray voltages V80 to V95 of a sixth group. The seventh staircase waveform gray voltage signal A7 may include the gray voltages V96 to V111 of a seventh group. The eighth staircase waveform gray voltage signal A8 may include the gray voltages V112 to V127 of an eighth group. The ninth staircase waveform gray voltage signal A9 may include the gray voltages V128 to V143 of a ninth group. The tenth staircase waveform gray voltage signal A10 may include the gray voltages V144 to V159 of a tenth group. The eleventh staircase waveform gray voltage signal A11 may include the gray voltages V160 to V175 of an eleventh group. The twelfth staircase waveform gray voltage signal A12 may include the gray voltages V176 to V191 of a twelfth group. The thirteenth staircase waveform gray voltage signal A13 may include the gray voltages V192 to V207 of a thirteenth group. The fourteenth staircase waveform gray voltage signal A14 may include the gray voltages V208 to V223 of a fourteenth group. The fifteenth staircase waveform gray voltage signal A15 may include the gray voltages V224 to V239 of a fifteenth group. The sixteenth staircase waveform gray voltage signal A16 may include the gray voltages V240 to V255 of a sixteenth group.

The staircase waveform gray voltage signal generation circuit 13 may include a plurality of decoders 13*a*-01, 13*a*-02, and 13*a*-03 to 13*a*-16 and a plurality of buffers 13*b*-01, 13*b*-02, 13*b*-03 to 13*b*-16. The staircase waveform gray voltage signal generation circuit 13 may further include a delay circuit 13*c* for adjusting a delay time. The delay circuit 13*c* may further include a register (not shown) for storing a delay time that is externally settable.

Accordingly, the delay circuit 13*c* may delay a signal corresponding to each bit constituting the 4-bit digital code (4-bit) by the set delay time.

In an embodiment, for example, the first decoder 13*a*-01 may receive the gray voltages V0 to V15 of the first group of the 256 gray voltages V0 to V255 and may output the first staircase waveform gray voltage signal A1 including the gray voltages V0 to V15 of the first group decoded according the 4-bit digital code (4-bit) or a 4-bit digital code delayed by the delay circuit 13*c*.

That is, as illustrated in FIG. 4, when the 4-bit digital code (4-bit) is sequentially increased from 0000 to 1111, the first decoder 13*a*-01 may output the first staircase waveform gray voltage signal A1, of which a gray voltage is sequentially increased from the gray voltage V15 to the gray voltage V0.

In the same manner as in the first decoder 13*a*-01, when the 4-bit digital code (4-bit) is sequentially increased from 0000 to 1111, the second to sixteenth decoders 13*a*-02 to 13*a*-16 may output the second to sixteenth staircase waveform gray voltage signals A2 to A16, of which gray voltages are sequentially increased, respectively.

The plurality of buffers 13*b*-01, 13*b*-02, and 13*b*-03 to 13*b*-16 may buffer the staircase waveform gray voltage signals A1 to A16 output from the plurality of decoders 13*a*-01, 13*a*-02, and 13*a*-03 to 13*a*-16, respectively. Each of the plurality of buffers 13*b*-01, 13*b*-02, and 13*b*-03 to 13*b*-16 may be implemented as a unit gain buffer. Each of the plurality of buffers 13*b*-01, 13*b*-02, and 13*b*-03 to 13*b*-16 may be implemented as an operational amplifier.

The plurality of PWM signals Track<0:5> generated by the signal generator 10 and the plurality of staircase waveform gray voltage signals A1 to A16 may be supplied to a plurality of channel drivers 20.

Figure 5:
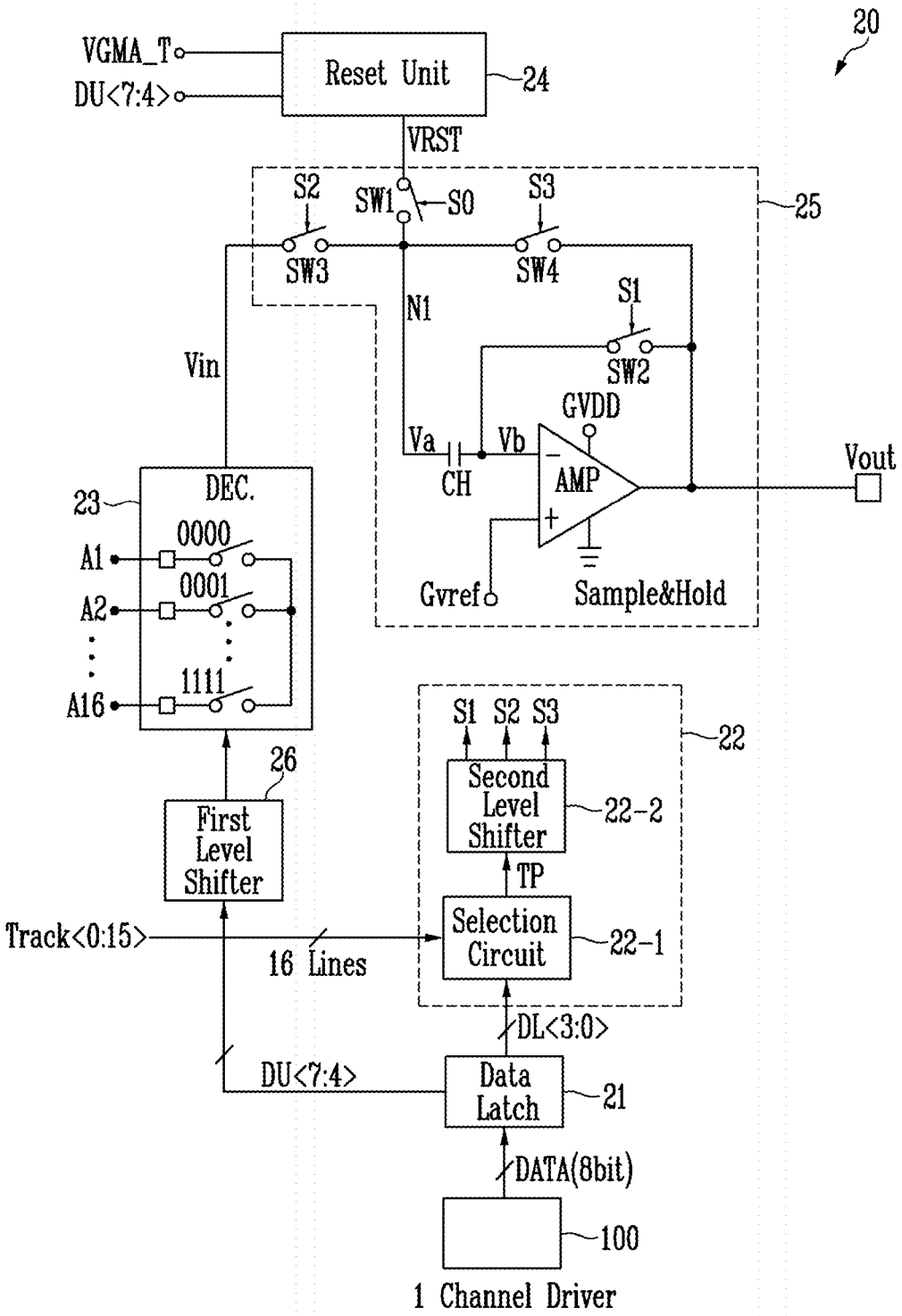
FIG. 5 is a schematic block diagram of a channel driver of FIG. 1.
Figure 7:
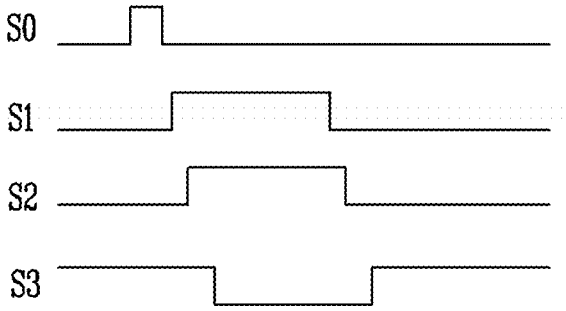
FIG. 7 illustrates timing diagrams between switches during sampling/holding according to an embodiment.

FIG. 5 is a schematic block diagram of the channel driver of FIG. 1. FIG. 6 is a graph showing a tracking process of a PWM signal. FIG. 7 illustrates timing diagrams between switches during sampling/holding according to an embodiment. FIG. 8 shows a table in which 8-bit image data is divided into upper 4-bits and lower 4-bits.

Referring to FIG. 5, the channel driver 20 may include a data latch 21, a switching signal generation circuit 22, a decoder 23, a reset unit 24, and an output circuit 25.

According to an embodiment of the present invention, the data latch 21 may receive and latch the image data DATA from the timing controller 100, may divide the latched image data DATA into upper bits DU<7:4> and lower bits DL<3:0>, and may output the divided upper bits DU<7:4> to the decoder 23 and output the divided lower bits DL<3:0> to the switching signal generation circuit 22.

In an embodiment, for example, when the image data DATA is 8-bit data, the data latch 21 may divide the latched 8-bit image data DATA into the upper 4-bits DU<7:4> and the lower 4-bits DL<3:0>.

The channel driver 20 may further include a first level shifter 26 which is connected between the data latch 21 and the decoder 23 and shifts a level of each of the upper 4-bits DU<7:4>. That is, the first level shifter 26 may shift the level of each of the upper 4-bits DU<7:4> in order to control operations of each switch implemented in the decoder 23. Therefore, the decoder 23 may output any one staircase waveform gray voltage signal of the plurality of staircase waveform gray voltage signals A1 to A16 in response to the upper 4-bits DU<7:4> level shifted by the first level shifter 26.

The switching signal generation circuit 22 may generate a plurality of switching signals S1, S2, and S3 using any one PWM signal TP selected from the plurality of PWM signals Track<0:15> output from the PWM signal generator 11-4 (see FIG. 3) in response to the lower 4-bits DL<3:0>.

The switching signal generation circuit 22 may include a selection circuit 22-1 for selecting any one PWM signal from the plurality of PWM signals Track<0:15> in response to the lower 4-bits DL<3:0> of the image data DATA.

When the lower 4-bits DL<3:0> are input to the selection circuit 22-1 and then the plurality of PWM signals Track<0:15> are input to the selection circuit 22-1, the selection circuit 22-1 may selectively output any one PWM signal from the plurality of PWM signals Track<0:15> in response to the lower 4-bits DL<3:0>.

In an embodiment, for example, as illustrated in FIG. 6, when the lower 4-bits DL<3:0> are "1010", a switch <10> may be turned on in response to "1010", and, thus, the selection circuit 22-1 may output a PWM signal Track<10>.

In the same manner as described above, the lower 4-bits DL<3:0> of the image data DATA are "0000," "0001," "0010," "0011," "0100," "0101," "0110," "0111," "1000," "1001," "1011," "1100," "1101," "1110," and "1111," the selection circuit 22-1 may output a PWM signal Track<0>, a PWM signal Track<1>, a PWM signal Track<2>, a PWM signal Track<3>, a PWM signal Track<4>, a PWM signal Track<5>, a PWM signal Track<6>, a PWM signal Track<7>, a PWM signal Track<8>, a PWM signal Track<9>, a PWM signal Track<11>, a PWM signal Track<12>, a PWM signal Track<13>, a PWM signal Track<14>, and a PWM signal Track<15> in response to the respective bits.

The switching signal generation circuit 22 may generate the plurality of switching signals S1, S2, and S3 having an increased level after the level of any one PWM signal TP output from the selection circuit 22-1 is increased.

That is, since a level of a PWM signal output from the selection circuit 22-1 is a logic level (for example, 1.5 V or less), in order to control a switching operation of each switch implemented in the output circuit 25, a high voltage level (for example, of 4 V to 6V) is required. Thus, the switching signal generation circuit 22 may further include a second level shifter 22-2 for shifting the level of any one PWM signal TP output from the selection circuit 22-1.

The decoder 23 may selectively output any one staircase waveform gray voltage signal of the plurality of staircase waveform gray voltage signals A1 to A16 in response to the upper 4-bits DU<7:4>. The decoder 23 may selectively output first to sixteenth staircase waveform gray voltage signals A1 to A16 in response to the upper 4-bits DU<7:4>.

In an embodiment, for example, as illustrated in FIGS. 4 and 6, when the upper 4-bits DU<7:4> of the image data are "0000", the decoder 23 may output the first staircase waveform gray voltage signal A1 to the output circuit 25.

In the same manner as described above, when the upper 4-bits DU<7:4> are "0001," "0010," "0011," "0100," "0101," "0110," "0111," "1000," "1001," "1010," "1011," "1100," "1101," "1110," and "1111", the decoder 23 may output the second to sixteenth staircase waveform gray voltage signals A2 to A16.

Before the staircase waveform gray voltage signals A1 to A16 selected by the decoder 23 are supplied to the output circuit 25 to be described below, the reset unit 24 may generate the reset voltage VRST using the gamma tap voltage VGMA_T (see FIG. 3) and the upper 4-bits DU<7:4> of the image data DATA and supply the reset voltage VRST to the output circuit 25. For example, the plurality of staircase waveform gray voltage signals A1 to A16 may be sampled/held every horizontal period. Accordingly, the reset unit 24 may supply the reset voltage VRST to the output circuit 25 every horizontal period.

According to an embodiment, the reset unit 24 may supply the gamma tap voltage VGMA_T (see FIG. 3) corresponding to an intermediate value between a final value of a staircase waveform gray voltage signal selected in a previous horizontal period (m−1)H and an initial value of a staircase waveform gray voltage signal selected in a current horizontal period (m)H to the output circuit 25 as the reset voltage VRST.

The output circuit 25 may perform a sampling/holding operation on a specific gray voltage level of a plurality of gray voltage levels V0 to V255 included in a staircase waveform gray voltage signal Vin output from the decoder 23 and may output an output voltage Vout obtained by amplifying a voltage held through the sampling/holding operation using an operational amplifier AMP to the pixel unit 500.

The output circuit 25 may include a capacitor CH, a plurality of switches SW1, SW2, SW3, and SW4, and the operational amplifier AMP. The output circuit 25 may perform a sampling/holding operation on a specific gray voltage level of the plurality of gray voltage levels included in the staircase waveform gray voltage signal Vin output from the decoder 23 using the capacitor CH and a switching operation of each switch and may amplify and output a voltage held in the capacitor CH through the sampling/holding operation using the operational amplifier AMP.

That is, the output circuit 25 may control timings of the plurality of switching signals S1, S2, and S3 in response to the selected PWM signal, thereby sampling and holding any one gray voltage of a plurality of gray voltages included in a selected staircase waveform gray voltage signal.

Referring to FIGS. 5 and 7, when a first switching signal S0 for controlling turn-on/off of a first switch SW1 transitions from a second level (for example, a low level) to a first level (for example, a high level), the first switch SW1 may be turned on. In this case, a voltage Va of a left terminal of the capacitor CH becomes the reset voltage VRST. According to an embodiment, the first switching signal S0 may be supplied from the timing controller 100.

Thereafter, when a second switching signal S1 for controlling turn-on/off of a second switch SW2 transitions from the second level (for example, a low level) to the first level (for example, a high level), the second switch SW2 is turned on. In this case, a voltage Vb of a second input terminal (for example, an inverting input terminal) of the operational amplifier AMP is set to a reference voltage Gvref. Here, the reference voltage Gvref may be set to a half of a supply voltage GVDD of the operational amplifier AMP. After that, when a third switching signal S2 for controlling turn-on/off of a third switch SW3 transitions from the second level to the first level, the third switch SW3 is turned on. In this case, while the third switching signal S2 maintains the first level, a specific gray voltage level of the plurality of gray voltage levels included in the staircase waveform gray voltage signal Vin, that is, a gray voltage level desired to be sampled, is charged in the left terminal of the capacitor CH.

Accordingly, the capacitor CH is charged with electric charges corresponding to a voltage difference (ΔVi=Vin−Vb) corresponding to a difference between a gray voltage level Vin to be sampled and the voltage Vb of a right terminal of the capacitor CH.

After the second switching signal S1 and the third switching signal S2 transition from the first level to the second level, when a fourth switching signal S3 transitions from the second level to the first level, since an output voltage Vout of the operational amplifier AMP is "zeo", the voltage Vb of a second input terminal of the operational amplifier AMP becomes −ΔVi. In this case, since the operational amplifier AMP operates in a differential mode, the operational amplifier AMP may amplify a voltage held in the capacitor CH.

As shown in the table shown in FIG. 8, the gray voltages V0 to V255 may be determined by combinations of the upper bits DU<7:4> and the lower bits DL<3:0> the image data DATA.

Figure 9:
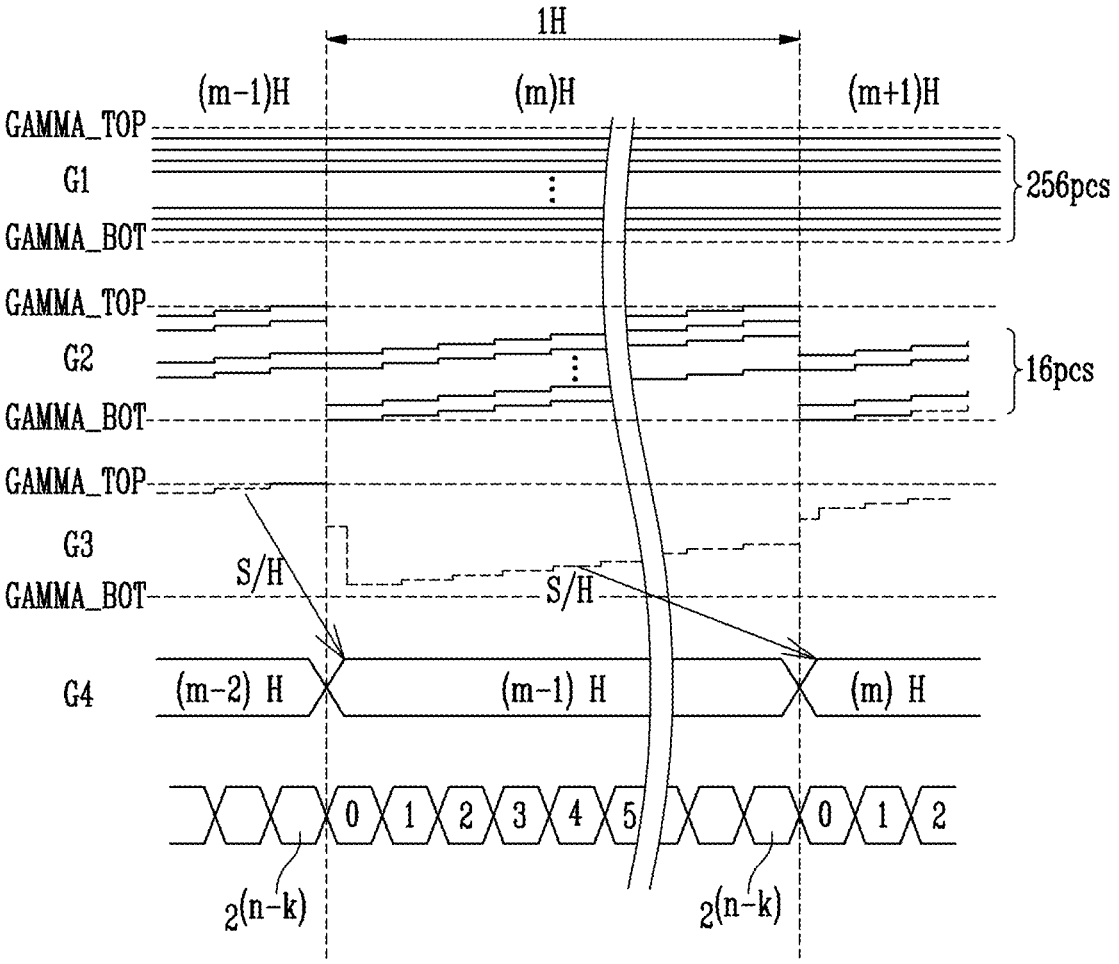
FIG. 9 shows graphs showing gamma voltage levels at specific points of a signal generator of FIG. 3 and a channel driver of FIG. 5.
Figure 10A:
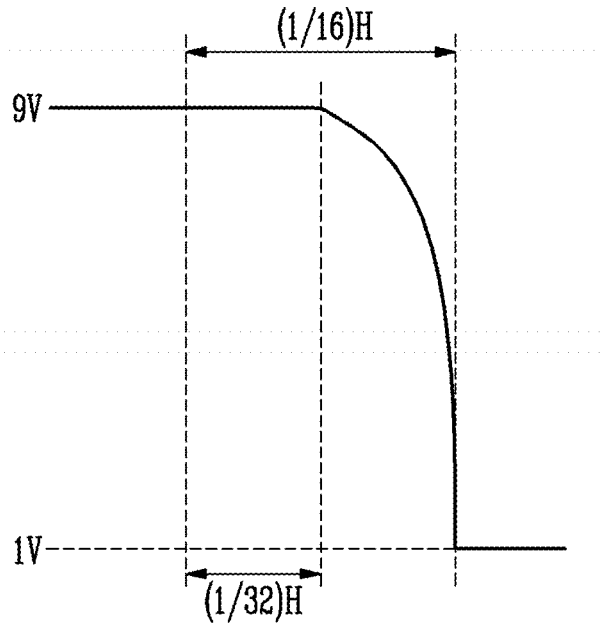
FIGS. 10A and 10B are graphs for describing an effect due to a reset unit.
Figure 10B:
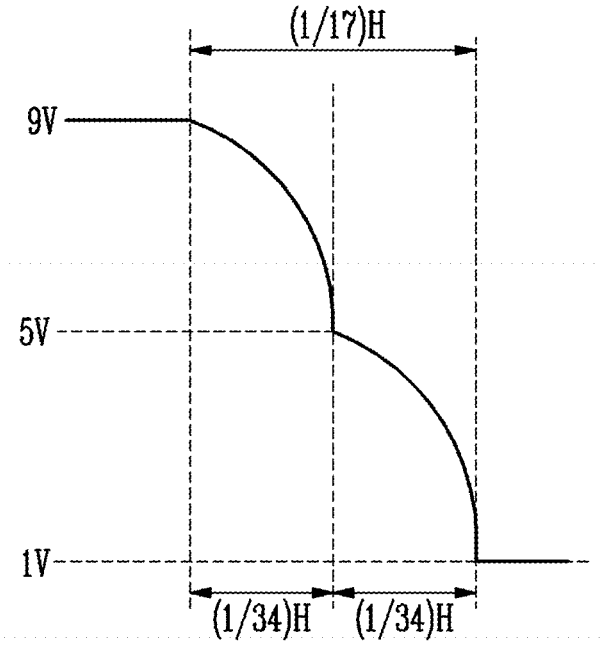

FIG. 9 shows graphs showing gamma voltage levels at specific points of the signal generator of FIG. 3 and the channel driver of FIG. 5. FIGS. 10A and 10B are graphs for describing an effect due to the reset unit. Here, "GAMMA_TOP" means maximum gamma voltage, "GAMMA_BOT" means minimum gamma voltage, and "S/H" means sampling/holding.

Referring to FIGS. 3, 5, and 9, a first graph G1 is a waveform diagram showing a gamma voltage level at an output terminal of the gray voltage generator 12, a second graph G2 is a waveform diagram showing a gamma voltage level at an output terminal of the staircase waveform gray voltage signal generation circuit 13, a third graph G3 is a waveform diagram showing a gamma voltage level at a first node N1 at which the reset unit 24 is connected to the output circuit 25, and a fourth graph G4 is a waveform diagram showing a gamma voltage level at an output terminal of the output circuit 25.

Referring to the first graph G1, at the output terminal of the gray voltage generator 12, a gamma voltage may correspond to each of the plurality of gray voltages V0 to V255 and may have 256 voltage levels that each maintain the same level during one horizontal period 1H.

Referring to the second graph G2, at the output terminal of the staircase waveform gray voltage signal generation circuit 13, a gamma voltage may be grouped into first to sixteenth staircase waveform gray voltage signals A1 to A16 and thus may have 16 voltage levels that are stepwise increased during one horizontal period 1H. In this case, a gamma voltage level of each of the first to sixteenth staircase waveform gray voltage signals A1 to A16 may be stepwise increased during one horizontal period 1H.

Referring to the third graph G3, at the first node N1 at which the reset unit 24 is connected to the output circuit 25, one staircase waveform gray voltage signal may be selected from first to sixteenth staircase waveform gray voltage signals A1 to A16 by the decoder 23, and thus, a gamma voltage may have one voltage level that is stepwise increased during one horizontal period 1H.

According to an embodiment, the reset unit 24 may supply the reset voltage VRST to the output circuit 25 every horizontal period 1H.

The reset unit 24 may detect a staircase waveform gray voltage signal selected in a previous horizontal period (m−1)H and a staircase waveform gray voltage signal selected in a current horizontal period (m)H using upper 4-bits DU<7:4> supplied from the decoder 23. The reset unit 24 may select one gamma tap voltage VGMA_T of the gamma tap voltages VGMA_T, which corresponds to an intermediate value between a final gray value of the staircase waveform gray voltage signal selected in the previous horizontal period (m−1)H and an initial gray value of the staircase waveform gray voltage signal selected in the current horizontal period (m)H and may supply the selected gamma tap voltage VGMA_T to the output circuit 25 as the reset voltage VRST.

According to an embodiment, the reset unit 24 may obtain an intermediate value by dividing the final gray value of the staircase waveform gray voltage signal selected in the previous horizontal period (m−1)H and the initial gray value of the staircase waveform gray voltage signal selected in the current horizontal period (m)H by two and may set a gamma tap voltage VGMA_T corresponding to the intermediate value as the reset voltage VRST.

In an embodiment, for example, in the reset unit 24, when the staircase waveform gray voltage signal selected in the previous horizontal period (m−1)H is the first staircase waveform gray voltage signal A1 and the staircase waveform gray voltage signal selected in the current horizontal period (m)H is the sixteenth gray voltage signal A16, the final gray value of the staircase waveform gray voltage signal selected in the previous horizontal period (m−1)H is V15, the initial gray value of the staircase waveform gray voltage signal selected in the current horizontal period (m)H is V240, and a difference value between the two values is V225. Thus, V225 divided by 2 is approximately V112. The gray voltage V112 corresponds to the gray voltages V112 to V127 of the eighth group, and the gray voltages V112 to V127 of the eighth group correspond to eighth gamma tap voltages VGMA_T8. As a result, the reset unit 24 may select the eighth gamma tap voltage VGMA_T8 as the reset voltage VRST from the plurality of gamma tap voltages VGMA_T.

Meanwhile, for a stable sampling/holding operation, it is necessary to reach a voltage level corresponding to a selected staircase waveform gray voltage within at least 1/16-horizontal period (1/16H). Preferably, when a target value is reached within a 1/32-horizontal period (1/32H), which is a half of the 1/16-horizontal period (1/16H), a stable sampling/holding operation is possible. For example, current consumption I during a sampling/holding operation may be calculated through Equation 1 below.

$$I = \frac{CH * \Delta V}{0.5 * \frac{1}{16} H} \quad \text{[Equation 1]}$$

wherein CH refers to a capacitance of a capacitor of the output circuit 25, and ΔV refers to a difference value between the final value of the staircase waveform gray voltage signal selected in the previous horizontal period (m−1)H and the initial value of the staircase waveform gray voltage signal selected in the current horizontal period (m)H.

Referring to FIG. 10A, when the reset voltage VRST is not applied from the reset unit 24, since a final value of the first staircase waveform gray voltage signal A1 selected in the previous horizontal period (m−1)H is about 9 V, and an initial value of the sixteenth staircase waveform gray voltage signal A16 selected in the current horizontal period (m)H is about 1 V, it can be seen that the difference ΔV is 8 V. Here, the current consumption I is about 12 microamperes (μA) when being calculated through Equation 1 above. However, in this case, as shown in Table 1 below, it is assumed that the capacitance of the capacitor of the output circuit 25 is 300 femtofarads (fF) and 1/32H is 200 nanoseconds (ns).

TABLE 1

| ΔV [V] | (1/32)H [ns] | CH [fF] | I [μA] |
|---|---|---|---|
| 8 | 200 | 300 | 12 |
| | | 400 | 16 |
| | | 500 | 20 |
| | | 600 | 24 |
| | | 700 | 28 |
| | | 800 | 32 |
| | | 900 | 36 |
| | | 1000 | 40 |

On the other hand, according to an embodiment of the present invention, in order to stably perform a sampling/holding operation, the sampling/holding operation may be stabilized at a voltage level corresponding to a staircase waveform gray voltage (or ramp signal) selected within a 1/17-horizontal period (1/17H).

In this case, the current consumption I during a sampling/holding operation may be calculated through Equation 2 below.

$$I = \frac{CH * \Delta V}{0.5 * \frac{1}{17} H} \quad \text{[Equation 2]}$$

wherein CH refers to the capacitance of the capacitor of the output circuit 25, and ΔV refers to a difference value between the final value of the staircase waveform gray voltage signal selected in the previous horizontal period (m−1)H and the initial value of the staircase waveform gray voltage signal selected in the current horizontal period (m)H.

Referring to FIG. 10B, when a final value of the first staircase waveform gray voltage signal A1 selected in the previous horizontal period (m−1)H is about 9 V, and an initial value of the sixteenth staircase waveform gray voltage signal A16 selected in the current horizontal period (m)H is about 1 V, since the eighth gamma tap voltage VGMA_T8 of about 5 V is applied from the reset unit 24 as the reset voltage VRST, it can be seen that ΔV is about 4 V. Here, the current consumption I during the sampling/holding operation is about 6.38 μA when being calculated through Equation 1 above. However, in this case, as shown in Table 2 below, it is assumed that the capacitance of the capacitor of the output circuit 25 is 300 fF and 1/32H is 188 ns.

TABLE 2

| ΔV [V] | (1/34)H [ns] | CH [fF] | I [μA] |
|---|---|---|---|
| 4 | 188 | 300 | 6.38 |
| | | 400 | 8.51 |
| | | 500 | 10.64 |
| | | 600 | 12.77 |
| | | 700 | 14.89 |
| | | 800 | 17.02 |
| | | 900 | 19.15 |
| | | 1000 | 21.28 |

That is, according to an embodiment, when the gamma tap voltage VGMA_T corresponding to the intermediate value between the final value of the staircase waveform gray voltage signal selected in the previous horizontal period (m−1)H and the initial value of the staircase waveform gray voltage signal selected in the current horizontal period (m)H is supplied to the output circuit 25 as the reset voltage VRST, the current consumption I during the sampling/holding operation may be reduced by about ½ times as compared with when the reset unit 24 does not supply the reset voltage VRST to the output circuit 25.

Referring again to the fourth graph G4 of FIG. 9, at the output terminal of the output circuit 25, a gamma voltage may have one voltage level of 16 voltage levels of a selected staircase waveform gray voltage signal, which is held through a sampling/holding operation. One held voltage level, that is, a data signal may maintain the same level during one horizontal period 1H. According to an embodiment, a data signal supplied to the pixel unit 500 (see FIG. 1) during a current horizontal period (m)H may have a voltage level held through a sampling/holding operation in a previous horizontal period (m−1)H. In this case, n refers to a resolution of the data driver 300, that is, the total number of bits of the image data DATA, and k refers to a number of upper bits of the image data DATA.

Hereinafter, other embodiments will be described. In the following embodiments, a description of the same configuration as that of the previously described embodiment will be omitted or simplified, and differences will be mainly described.

Figure 11:
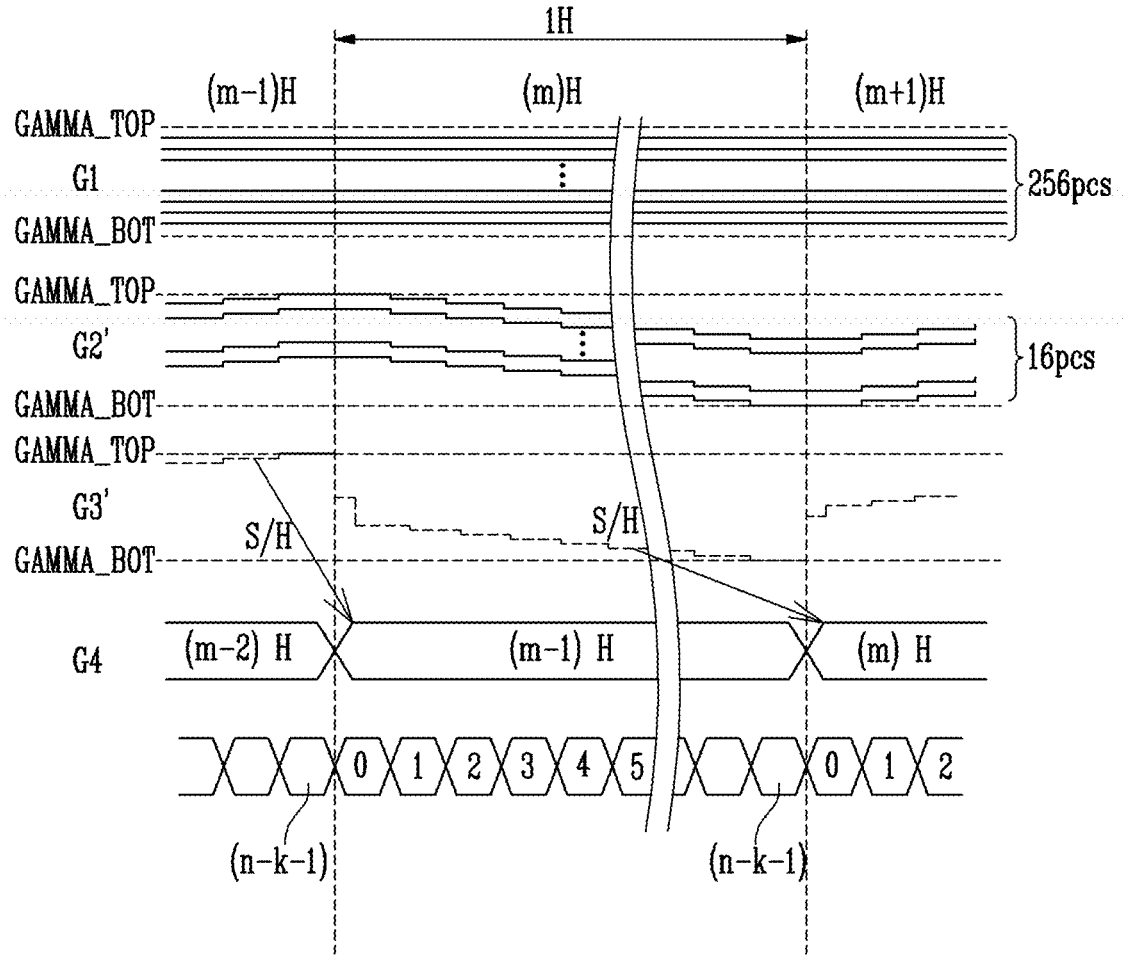
FIG. 11 shows graphs showing gamma voltage levels at specific points of the signal generator of FIG. 3 and the channel driver of FIG. 5 according to another embodiment of the present invention.
Figure 12:
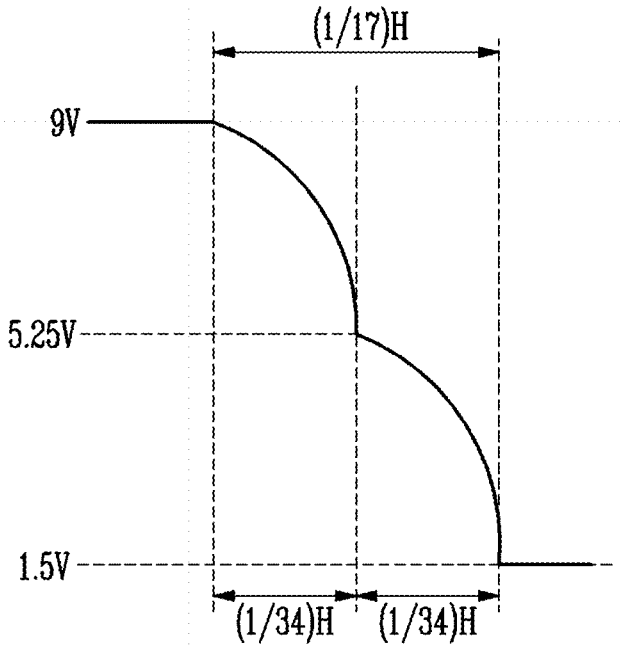
FIG. 12 is a graph for describing an effect according to the embodiment of FIG. 11.

FIG. 11 shows graphs showing gamma voltage levels at specific points of the signal generator of FIG. 3 and the channel driver of FIG. 5 according to another embodiment of the present invention. FIG. 12 is a graph for describing an effect according to the embodiment of FIG. 11. Here, "GAMMA_TOP" means maximum gamma voltage, "GAMMA_BOT" means minimum gamma voltage, and "S/H" means sampling/holding.

Since a first graph G1 and a fourth graph G4 shown in FIG. 11 are substantially the same as those of FIG. 9, redundant descriptions will be omitted, and differences between a second graph G2' and a graph G3' shown in FIG. 11 and the second graph G2 and the third graph G3 shown in FIG. 9 will be mainly described.

Referring to the second graph G2' of FIG. 11, the staircase waveform gray voltage signal generation circuit 13 in this embodiment is different from the staircase waveform gray voltage signal generation circuit 13 according to the embodiment of FIG. 9 in that the staircase waveform gray voltage signal generation circuit 13 in this embodiment outputs the staircase waveform gray voltage signals A1 to A16 including 16 gray voltages in the increasing order and the decreasing order of the voltage value alternately every other horizontal period 1H, and the staircase waveform gray voltage signal generation circuit 13 according to the embodiment of FIG. 9 outputs staircase waveform gray voltage signals A1 to A16 including 16 gray voltages in the increasing order of the voltage value every horizontal period 1H.

Referring to the second graph G3' of FIG. 11, at the first node N1 (see FIG. 5) at which the reset unit 24 is connected to the output circuit 25, one staircase waveform gray voltage signal may be selected and may have a voltage level that is stepwise decreased or increased alternately every horizontal period 1H.

Referring to FIG. 12, as illustrated in FIG. 9, when a first staircase waveform gray voltage signal A1 is selected in a previous horizontal period (m−1)H and a sixteenth staircase waveform gray voltage signal A16 is selected in a current horizontal period (m)H, since the first staircase waveform gray voltage signal A1 has a voltage level that is stepwise increased, a final value of the first staircase waveform gray voltage signal A1 may have the same voltage of about 9 V, but since the sixteenth staircase waveform gray voltage signal A16 has a voltage level that is stepwise decreased, an initial value of the sixteenth staircase waveform gray voltage signal A16 may be changed into about 1.5 V. In this case, since a seventh gamma tap voltage VGMA_T7 of about 5.25 V is applied from the reset unit 24 as a reset voltage VRST, it can be seen that ΔV is about 3.75 V. Here, the current consumption I during the sampling/holding operation is about 5.98 μA when being calculated through Equation 2 above. However, in this case, as shown in Table 3 below, it is assumed that the capacitance of the capacitor of the output circuit 25 is 300 fF and 1/32H is 188 ns.

TABLE 3

| ΔV [V] | (1/34)H [ns] | CH [fF] | I [μA] |
|---|---|---|---|
| 3.75 | 188 | 300 | 5.98 |
| | | 400 | 7.97 |
| | | 500 | 9.97 |
| | | 600 | 11.96 |
| | | 700 | 13.96 |
| | | 800 | 15.95 |
| | | 900 | 17.95 |
| | | 1000 | 19.94 |

A difference value ΔV between the final value of the staircase waveform gray voltage signal selected in the previous horizontal period (m−1)H and the initial value of the staircase waveform gray voltage signal selected in the current horizontal period (m)H is decreased, thereby further reducing the current consumption I during the sampling/holding operation.

In a method of supplying the number of ramp signals less than the number of gray voltages to a decoder, a data driver according to embodiments of the present invention applies a reset voltage in response to starting points of the ramp signals using a gamma tap voltage, thereby reducing average current consumption during a sampling/holding operation.

In a method of supplying the number of ramp signals less than the number of gray voltages to a decoder, a data driver according to embodiments of the present invention applies a reset voltage in responds to starting points of the ramp signals using a gamma tap voltage, thereby maintaining the linearity of the ramp signals during a sampling/holding operation.

However, effects of the present invention are not limited to the above-described effect, but variously modified without departing from the spirit and scope of the present invention.

Although the present invention has been described with reference to the embodiments, those skilled in the art will appreciate that various modifications and variations can be made in the present invention without departing from the spirit or scope of the invention described in the appended claims.

What is claimed is:

1. A data driver comprising:

a signal generator which includes a staircase waveform gray voltage signal generator which generates a plurality of staircase waveform gray voltage signals using a lowest gamma reference voltage, a highest gamma reference voltage, and a plurality of gamma voltages having a magnitude between the lowest gamma reference voltage and the highest gamma reference voltage; and a channel driver which includes a decoder which outputs one staircase waveform gray voltage signal selected from the staircase waveform gray voltage signals, an output circuit which outputs a gray voltage corresponding to the selected staircase waveform gray voltage signal, and a reset unit which supplies one of the gamma voltages to the output circuit as a reset voltage.

2. The data driver of claim 1, wherein the decoder selects one staircase waveform gray voltage signal from the plurality of staircase waveform gray voltage signals every horizontal period.

3. The data driver of claim 2, wherein the reset voltage is the one gamma voltage of the plurality of gamma voltages, which corresponds to an intermediate value between a final gray voltage of one staircase waveform gray voltage signal selected in a previous horizontal period and an initial gray voltage of one staircase waveform gray voltage signal selected in a current horizontal period.

4. The data driver of claim 3, wherein the reset unit detects the one staircase waveform gray voltage signal selected in the previous horizontal period and the one staircase waveform gray voltage signal selected in the current horizontal period using upper bits of image data supplied to the decoder.

5. The data driver of claim 2, wherein the reset unit supplies the reset voltage to the output circuit every horizontal period and supplies the reset voltage to the output circuit before the one staircase waveform gray voltage signal selected by the decoder is supplied to the output circuit.

6. The data driver of claim 1, wherein each of the plurality of staircase waveform gray voltage signals increases stepwise with a plurality of gray voltage levels every horizontal period.

7. The data driver of claim 1, wherein each of the plurality of staircase waveform gray voltage signals alternately increases and decreases stepwise with a plurality of gray voltages every other horizontal period.

8. The data driver of claim 1, wherein the signal generator further includes a pulse width modulation (PWM) signal generation circuit which generates a plurality of PWM signals according to a digital code generated based on an oscillation signal, wherein the PWM signal generation circuit includes:

an oscillator which generates the oscillation signal;

a frequency divider which divides a frequency of the oscillation signal at a constant division ratio and generates an oscillation signal having the divided frequency;

a code generator which counts the oscillation signal having the divided frequency and generates the digital code as a result of the count; and a PWM signal generator which generates the plurality of PWM signals in response to the digital code.

9. The data driver of claim 8, wherein the channel driver further includes a switching signal generation circuit which generates a plurality of switching signals using any one PWM signal selected from the plurality of PWM signals in response to lower bits, wherein the switching signal generation circuit includes:

a selection circuit which outputs the one PWM signal selected from the plurality of PWM signals in response to the lower bits of image data; and a level shifter which generates the plurality of switching signals by shifting a level of the one PWM signal output from the selection circuit.

10. The data driver of claim 9, wherein the output circuit includes:

a capacitor and a plurality of switches which perform a sampling/holding operation on the gray voltage corresponding to the selected staircase waveform gray voltage signal in response to the plurality of switching signals; and an operational amplifier which amplifies a voltage held in the capacitor through the sampling/holding operation.

11. The data driver of claim 10, wherein the operational amplifier includes a first input terminal which receives a reference voltage, a second input terminal connected to a first terminal of the capacitor, and an output terminal, the capacitor includes a second terminal connected to a first node, and the plurality of switches includes a first switch positioned between the reset unit and the first node, a second switch positioned between the second input terminal of the operational amplifier and the output terminal of the operational amplifier, and a third switch positioned between an output terminal of the decoder and the first node, and a fourth switch positioned between the output terminal of the operational amplifier and the first node.

12. The data driver of claim 11, wherein the first switch is turned on before the third switch is turned on and then the first switch is turned off after the third switch is turned.

13. A display device comprising:

a pixel unit which includes a plurality of pixels connected to data lines; and a data driver which supplies data signals to the data lines, wherein the data driver includes a signal generator which includes a staircase waveform gray voltage signal generation which generates a plurality of staircase waveform gray voltage signals using a lowest gamma reference voltage, a highest gamma reference voltage, and a plurality of gamma voltages having a magnitude between the lowest gamma reference voltage and the highest gamma reference voltage, and a channel driver which includes a decoder which outputs one staircase waveform gray voltage signal selected from the staircase waveform gray voltage signals, an output circuit which outputs a gray voltage corresponding to the selected staircase waveform gray voltage signals to the data line as a data signal, and a reset unit which supplies one of the gamma voltages to the output circuit as a reset voltage.

14. The display device of claim 13, wherein the decoder selects one staircase waveform gray voltage signal from the plurality of staircase waveform gray voltage signals every horizontal period.

15. The display device of claim 14, wherein the reset voltage is the one gamma voltage of the plurality of gamma voltages, which corresponds to an intermediate value of a final gray voltage of one staircase waveform gray voltage signal selected in a previous horizontal period and an initial gray voltage of one staircase waveform gray voltage signal selected in a current horizontal period.

16. The display device of claim 15, wherein the reset unit detects the one staircase waveform gray voltage signal selected in the previous horizontal period and the one staircase waveform gray voltage signal selected in the current horizontal period using upper bits of image data supplied to the decoder.

17. The display device of claim 14, wherein the reset unit supplies the reset voltage to the output circuit every horizontal period and supplies the reset voltage to the output circuit before the one staircase waveform gray voltage signal selected by the decoder is supplied to the output circuit.

18. The display device of claim 13, wherein each of the plurality of staircase waveform gray voltage signals increases stepwise with a plurality of gray voltage levels every horizontal period.

19. The display device of claim 13, further comprising a gamma reference voltage supply unit which supplies the lowest gamma reference voltage, the highest gamma reference voltage, and the plurality of gamma voltages to the data driver.

20. A display device comprising:

a pixel unit which includes pixels connected to a plurality of scan lines and a plurality of data lines;

a data driver which supplies one staircase waveform gray voltage signal selected from a plurality of staircase waveform gray voltage signals to the pixel unit through the data line every horizontal period; and a scan driver which sequentially supplies scan signals to the pixel unit through the scan lines every horizontal period, wherein the data driver outputs a reset voltage between a previous horizontal period and a current horizontal period.

* * * * *